US005651394A

United States Patent [19]

Marchand

[11] Patent Number: 5,651,394

[45] Date of Patent: Jul. 29, 1997

[54] PAPERMAKERS FABRIC HAVING CABLED MONOFILAMENT OVAL-SHAPED YARNS

[75] Inventor: René Marchand, Raleigh, N.C.

[73] Assignee: Huyck Licensco, Inc., Wilmington, Del.

[21] Appl. No.: 595,773

[22] Filed: Feb. 2, 1996

[51] Int. Cl.[6] ..... D03D 15/00

[52] U.S. Cl. ..... 139/383 A; 139/426 R; 442/195

[58] Field of Search ..... 139/383 A, 426 R, 139/425 A; 428/234

[56] References Cited

U.S. PATENT DOCUMENTS

| | | | |
|---|---|---|---|
| 3,158,984 | 12/1964 | Butler | 139/425 A X |
| 3,918,134 | 11/1975 | Dean . | |
| 3,924,663 | 12/1975 | Dean . | |
| 4,015,641 | 4/1977 | Goff, Jr. et al. . | |
| 4,351,874 | 9/1982 | Kirby | 139/383 A |
| 4,381,612 | 5/1983 | Shank | 139/383 AA |
| 4,414,263 | 11/1983 | Miller et al. | 139/383 A |
| 4,588,632 | 5/1986 | Gisbourne et al. | 139/383 A |
| 4,632,716 | 12/1986 | Smith | 139/383 A |
| 4,705,601 | 11/1987 | Chiu | 139/383 A |
| 4,883,097 | 11/1989 | Dufour | 139/383 A |
| 5,005,610 | 4/1991 | Davenport | 139/383 AA |
| 5,346,590 | 9/1994 | Jaala | 139/383 A |
| 5,360,518 | 11/1994 | McCarthy et al. | 139/383 A |
| 5,368,696 | 11/1994 | Cunnane, III et al. | 139/383 A |
| 5,429,686 | 7/1995 | Chiu et al. | 139/383 A |
| 5,449,548 | 9/1995 | Bown, Jr. | 139/383 A |
| 5,466,339 | 11/1995 | Legge | 139/383 A |

*Primary Examiner*—Andy Falik

*Attorney, Agent, or Firm*—Bell, Seltzer, Park & Gibson, P.A.

[57] ABSTRACT

A papermaker's fabric for use in the press section of a papermaking machine having a base fabric layer woven from either oval shaped monofilament yarns or "cabled monofilament oval yarns", which are cabled yarns comprised of two or more oval shaped monofilament yarns.

14 Claims, 2 Drawing Sheets

PAPERMAKERS FABRIC HAVING CABLED MONOFILAMENT OVAL-SHAPED YARNS

BACKGROUND OF THE INVENTION

The field of the invention is felts for use in a papermaking machine, and more particularly, press felts for use in the press section of a papermaking machine.

In the conventional papermaking process, a water slurry or suspension of cellulose fibers, known as the paper "stock", is fed onto the top of the upper run of a traveling endless forming belt. The forming belt provides a papermaking surface and operates as a filter to separate the cellulosic fibers from the aqueous medium to form a wet paper web. In forming the paper web, the forming belt serves as a filter element to separate the aqueous medium from the cellulosic fibers by providing for the drainage of the aqueous medium through its mesh openings, also known as drainage holes, by vacuum means or the like located on the drainage side of the fabric.

After leaving the forming medium, the somewhat self-supporting paper web is transferred to the press section in the machine and onto a press felt, where still more of its water content is removed by passing it through a series of pressure nips formed by cooperating press rolls, these press rolls serving to compact the web as well. It is this press felt which is the subject of the present invention.

Subsequently, the paper web is transferred to a dryer section where it is passed about and held in heat transfer relation with a series of heated generally cylindrical rolls to remove still further amounts of water therefrom.

Ideally, press felts should have at least the following properties. First, they should have a top surface that is fine enough to produce a smooth finish and minimize marking of the sheet of paper being produced. Second, they should be open enough to allow water to drain through without significant impedance. Third, the felts should be resilient enough to quickly recover from repeated high nip pressures over a long period of time. Fourth, they should be tough and strong enough to provide good stability, wear resistance and felt life.

The base fabric layer of the press felt can be woven or nonwoven. The woven base fabric may be a single layer, a double layer, a triple layer fabric, or a laminated fabric. The term "single layer" as used herein refers to a fabric comprising one set of machine direction yarns and one set of cross machine direction yarns. "Double layer" refers to a fabric comprising two sets of cross machine direction yarns interweaving them. "Triple layer" refers to a fabric comprising two complete weaves. Each weave includes one set of machine direction yarns and one set of cross machine direction yarns. A thread or threads interweaves the two weaves to produce the triple layer fabric. A laminated base fabric is comprised of two or more base fabric layers.

In felts having a base fabric assembly with two or more layers of woven fabric, the top layer can be woven fine to prevent marking from the coarser machine side bottom layer and to provide good retention of the needled fibers. Also the top woven fabric can be more compressible than the bottom layer. The other layer, the bottom base fabric layer, can be made relatively coarse so that it has a high void volume and a high degree of compaction resistance and wear resistance.

Generally, press felts are assembled in the following manner. If the base fabric is not woven endless, the ends are joined by stitching a seam in a conventional manner. The base fabric is then installed on a needle loom. Where multilayer base fabrics are employed, the fine layer comprises the outside or top loop. Batt fibers are applied to the top side or paper contacting surface of the base fabric layer of the press felt, in sufficient quantity and weight to give good bulk and cushion properties. The fibers are anchored to the base fabric layer by one or more needling operations. Thus, the surface of the press felt which contacts the paper web is a felt, formed as the batting material fibers are needled to the base fabric. Fibers may also be needled to the bottom of the woven base fabric to ensure good anchoring of the fibers on the top side.

Needling the entire structure gives the felt a uniform thickness. Needling also provides a cushioned absorbency to the felt and distributes the pressure uniformly across the width of the felt for efficient water removal. Both uniform thickness and pressure distribution help to reduce vibration of the press rolls of the papermaking machine. Needling is necessary to compress the felt to a given density and resiliency and to entangle the fibers in the base fabric so they do not come loose during the papermaking operation.

The batt material may be made up of fibers of any of a number of well known compositions, including natural fibers such as wool, but preferably will be made in whole or in part from synthetic materials such as nylon, dacron, etc. In this connection, it is desirable that these fibers be relatively coarse or of large diameter. They will be selected for their compaction resistance, that is, their tendency to resist bending or deformation at fiber cross-over points since this enhances their ability to produce a good papermaking surface.

It is desirable to have a felt which is soft and easy to bend, since a certain amount of bunching is required in order to install the fabrics on the machine. A problem with existing felts is that they tend to be rather stiff and inflexible, which makes installation on the papermaking machine difficult.

It is also desirable to have a papermaking fabric with optimum drainage characteristics. The drainage characteristics of a papermaking fabric greatly affect the quality and type of paper produced on that fabric. These characteristics include the amount of void space per surface area, the amount of void volume per volume of fabric, the average area of a clear path straight through the papermaker's fabric, and the relative percentage of fabric area contacting the paper as it relates to the total area of the paper. The desired press felts are woven so as to have relatively large open areas or voids which will enhance the fabric's water conveying capabilities so that the water may be removed from the felt upon passage over a suction box.

It is also desirable to a have felt which aids in minimizing vibration problems related to the pressing of water from the web. The press section of a papermaking machine includes transport rollers that move the papermaking fabric along, with the paper web supported above the fabric. Above the paper web are arranged several press rolls. An upper press roll is located opposite a cooperating roll located below the papermaking fabric. The purpose of the press roll is to press down upon the wet web and squeeze water out from the paper and into the fabric. The rolls press down with a force of about 700 pounds per lineal inch. Thus, for a roll forty feet wide, the roll experiences 336,000 pounds of force. At the same time, the paper moves past the roll at 1,000 meters per minute. Thus, the press roll is spinning at a high rate, under an extreme load. The roll is supported from above by a frame, with shock absorber type elements interposed between the roll and the frame. However, any slight imbalance in the roll, which invariably arises, causes the press roll to shake and vibrate. Due to the extreme forces, this vibration causes flattening of the roll, which further exacerbates the vibration. Eventually, the roll vibrates to such a degree that the entire portion of the building housing the press section quakes.

Aside from the obvious noise pollution and physical discomfort, a wildly vibrating roll presents several other problems. First, paper manufactured with such a roll is irregular and cannot be used for fine applications. Further the vibration of the roll ruins the rolls, which must be removed and reground to return to a balanced state. Similarly, the vibration loosens many of the components in the papermaking machine itself. The machine then must be frequently serviced. Finally, the vibration causes the papermaking fabric to compact to a certain degree, such that it no longer exhibits the desired drainage and vibration accommodation characteristics.

Thus, it is an object of the present invention to provide a papermaker's fabric which is easier to install on the papermaking machine.

It is another object of the invention to provide a papermaking fabric which is softer and easier to bend than conventional fabrics.

It is another object of the present invention to provide a papermaker's fabric having enhanced capacity for removing water from a paper sheet.

It is another object of the invention to provide a papermaker's fabric which has greater void for drainage.

It is another object of the present invention to provide a papermaker's fabric which has optimum bulk and weight.

It is another object of the present invention to provide a papermakers' fabric for the press section of a papermakers' machine which minimizes the vibration of the press roll.

SUMMARY OF THE INVENTION

The invention accomplishes the objects set forth above by providing a papermaker's fabric having oval shaped yarns. The base fabric layer of a press felt may be woven from oval shaped monofilament yarns or from "cabled monofilament oval yarns", which are cabled yarns comprised of two or more oval shaped monofilament yarns. Fabrics woven with these yarns have less stiffness and are easier to bend than fabrics woven from conventional circular yarns. As a result, they are easier to install on the papermaking machine. Furthermore, when the monofilament oval yarns are cabled, the resulting cabled yarn is bulkier yarn than the conventional cabled yarn made from circular yarns. This increase in bulk produces a felt with greater void for improved drainage.

A further advantage of fabrics having oval shaped yarns is that the yarns tend to torque upon entry into the press section of the papermaking machine. This allows for greater surface contact while the fabric is under pressure, but when the pressure is released, the fabric opens back up. This feature leads to better dewatering. In addition, this movement of the yarn allows the felt to absorb more energy from the press rolls, thus dampening possible vibrations on the paper machine.

The invention may also be seen from the following detailed description of the invention and from the following drawing, in which like reference numbers refer to like members in the various figures.

DETAILED DESCRIPTION OF THE PREFERRED EMBODIMENT

It has been found that the papermaker's fabric of the present invention provides a superior fabric which is easier to install on the papermaking machine and has optimum drainage characteristics. At the same time, the fabric has a high vibration absorption capacity which provides better runnability, fewer maintenance stops, and improved paper quality.

Figure 1:
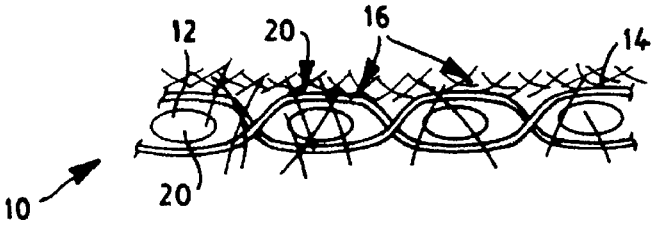
FIG. 1 is a cross sectional view of a papermaker's fabric woven from oval shaped monofilament yarns.
Figure 2:
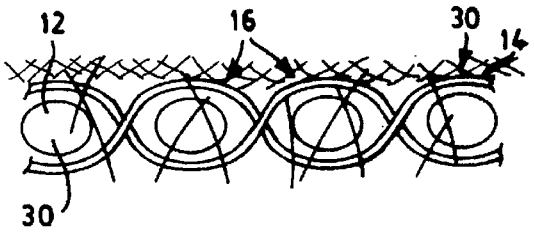
FIG. 2 is a cross sectional view of a papermaker's fabric woven from cabled monofilament oval yarns.

FIG. 1 shows one embodiment of a press felt of the present invention in which the base fabric layer 10 is woven from oval shaped monofilament yarns 20. FIG. 2 shows another embodiment of the present invention in which the base fabric layer 10 is woven from cabled monofilament oval yarns 30.

Figure 7:
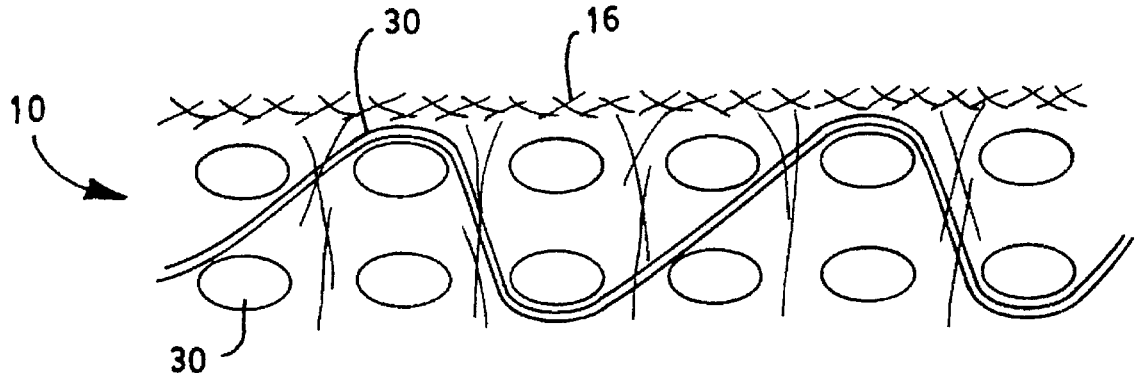
FIG. 7 is a cross sectional view of a double layer papermaker's fabric having cabled monofilament yarns.
Figure 8:
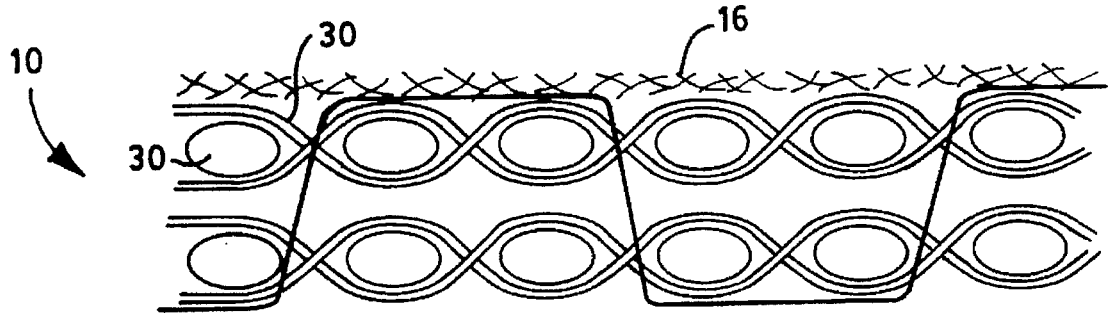
FIG. 8 is a cross sectional view of a triple layer papermaker's fabric having cabled monofilament yarns.
Figure 9:
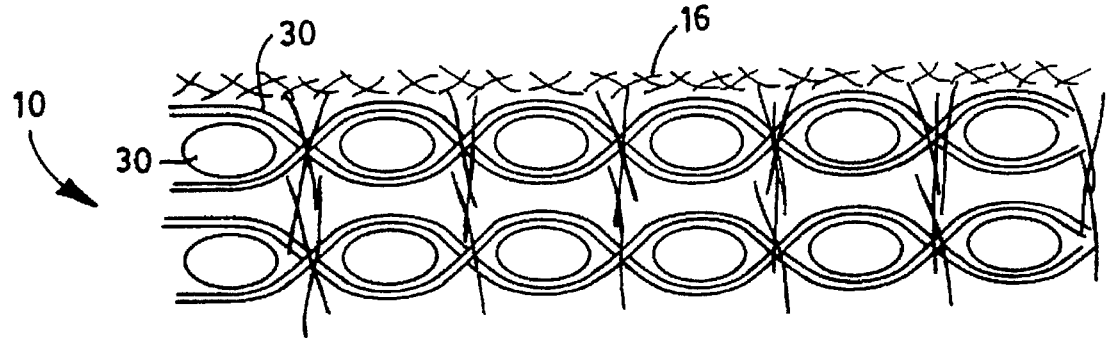
FIG. 9 is a cross sectional view of a laminated papermaker's fabric having cabled monofilament yarns.

The fabric which makes up the base fabric layer 10 can be chosen for the qualities desired in the press felt. In the fabrics shown in FIGS. 1 and 2, a single layer base fabric 10 is provided. It has machine direction yarns 12 and cross machine direction yarns 14. The base fabric 10 could also be a double layer fabric, (FIG. 7) triple layer fabric, (FIG. 8) or a laminated fabric (FIG. 9). The term "single layer" as used herein refers to a fabric comprising one set of machine direction yarns and one set of cross machine direction yarns. "Double layer" refers to a fabric comprising two sets of cross machine direction yarns interweaving them. "Triple layer" refers to a fabric comprising two complete weaves. Each weave in the triple layer fabric includes one set of machine direction yarns and one set of cross machine direction yarns. A thread or threads interweaves the two weaves to produce the triple layer fabric. A laminated base fabric is a base fabric comprised of two or more base fabric layers.

A layer of batt fibers 16 is placed adjacent to the base fabric layer 10 and needled into place. Needling the entire structure gives the felt a uniform thickness. Needling also provides a cushioned absorbency to the felt and distributes the pressure uniformly across the width of the felt for efficient water removal. Both uniform thickness and pressure distribution help to reduce vibration of the press rolls of the papermaking machine. Needling is necessary to compress the felts to a given density and resiliency and to entangle the fibers in the base fabric so they do not come loose during the papermaking operation.

The batt fibers 16 may be made of any of a number of well known compositions, including natural fibers such as wool, but preferably will be made in whole or in part from synthetic materials such as nylon, dacron, etc. In this connection, it is desirable that these fibers 16 be relatively coarse or of a large diameter. They will be selected for their compaction resistance, that is, their tendency to resist bending or deformation at fiber cross-over points since this enhances their ability to produce a goods papermaking surface.

Figure 3:
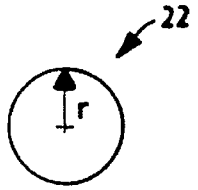
PRIOR ART FIG. 3
FIG. 3 is a cross sectional view of a prior art circular yarn.
Figure 4:
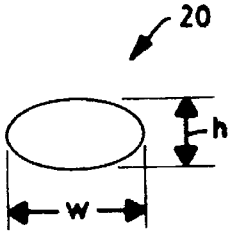
FIG. 4 is a cross sectional view of an oval shaped monofilament yarn according to the present invention.
Figure 6:
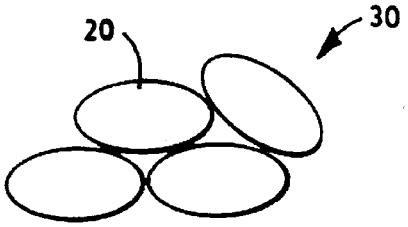
FIG. 6 is a cross sectional view of a cabled oval yarn according to the present invention.

As noted above, the base fabric layer 10 may be woven from either the oval shaped monofilament yarns 20 shown in FIG. 4 or from the cabled monofilament oval yarns 30 shown in FIG. 6. FIG. 4 shows an oval shaped monofilament yarn 30 of the present invention having a height h and a width w. FIG. 3 shows a prior art circular yarn 22 having a radius r. The oval shaped yarn 20 shown in FIG. 4 is of approximately the "same size" as the circular yarn 22 shown in FIG. 4, i.e. the surface area of a cross section of the oval shaped yarn 20 is approximately equal to the surface area of a cross section of the circular yarn 22. In the preferred embodiment, the height h of the oval shaped monofilament yarn 20 is less than the radius r of the corresponding circular yarn 22 shown in FIG. 3. In other words, the height h of the oval shaped monofilament yarn 20 of the preferred embodiment is less than the radius of a circular yarn 22 of approximately the same size.

Figure 5:
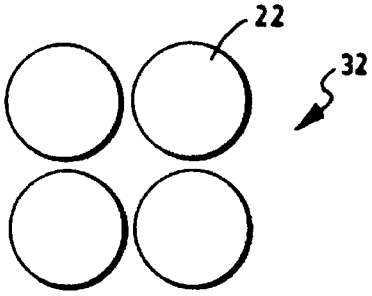
PRIOR ART FIG. 5
FIG. 5 is a cross sectional view of a cabled yarn of the prior art.

FIG. 6 shows a cross section of a cabled monofilament oval yarn 30 of the present invention. The cabled monofilament oval yarn 30 is comprised of four oval shaped monofilament yarns 20. Although FIG. 6 shows a cabled oval yarn having four oval shaped monofilament yarns 20, it is to be understood that the cabled monofilament oval yarn may be any yarn comprised of two or more oval shaped monofilament yarns 20. FIG. 5 shows a cross section of a prior art cabled yarn 32 comprised of four circular yarns 22. Although the circular yarns 22 of the prior art cabled yarn 32 are of approximately the same size as the oval shaped monofilament yarns 20 of the cabled monofilament oval yarns 30 (i.e. the surface area of a cross section of the oval shaped yarn 20 is approximately equal to the surface area of a cross section of the circular yarn 22), the cabled oval yarn 30 is bulkier yarn than the conventional circular yarn 32. The bulkier yarn produces a fabric with greater void, which results in improved drainage.

As noted above, the drainage characteristics of a papermaking fabric greatly affect the quality and type of paper produced on that fabric. These characteristics include the amount of void space per surface area, the amount of void volume per volume of fabric, the average area of a clear path straight through the papermaker's fabric, and the relative percentage of fabric area contacting the paper as it relates to the total area of the paper. A fabric woven with the cabled monofilament oval yarns 30 of the present invention has large open areas or voids which enhance the fabric's water conveying capabilities so that the water may be removed from the felt upon passage over a suction box.

A further advantage of fabrics having oval shaped yarns is that the yarns tend to torque upon entry into the press section of the papermaking machine. This allows for greater surface contact while the fabric is under pressure, but when the pressure is released, the fabric opens back up. This feature leads to better dewatering. In addition, this movement of the yarn allows the felt to absorb more energy from the press rolls, thus dampening possible vibrations on the paper machine. This results in better runnability, fewer maintenance stops and improved paper quality.

The oval shaped monofilament yarns 20 may be produced from wool, cotton, polyolefins, polyamides, polyesters, mixtures thereof and the like. The size of the oval shaped monofilament yarns 20 will depend on the desired characteristics of the fabric. A typical yarn has a height h ranging from 4 to 20 mil, and a width w ranging from 6 to 25 mil. Because the oval shaped yarns are less stiff than the conventional circular yarns, they are easier to weave. Therefore, it is possible to use larger yarns, if desired.

The invention may be embodied in other specific forms without departing from the spirit or essential characteristics thereof. For example, the invention is not limited to the oval shaped monofilament yarns described in the preferred embodiment. Any yarns having more or less the shape of a flattened or elongated circle, or ellipse may be used. The base fabric may be woven from a combination of oval shaped yarns and circular yarns. The cabled monofilament oval yarns and/or the oval shaped monofilament yarns may be utilized in the cross machine direction and/or the machine direction of any fabric design.

The present embodiments are therefore to be considered in all respects as illustrative and not restrictive, the scope of the invention being indicated by the appended claims rather than by the foregoing description, and there is no intention to exclude any equivalents thereof. Hence, it is recognized that various modifications are possible within the scope of the present invention as claimed.

What is claimed is:

1. A papermaker's fabric for use in the press section of a papermaking machine comprising a base fabric layer having a plurality of cabled monofilament oval yarns, each of said cabled monofilament oval yarns having two or more oval shaped monofilament yarns, each of said oval shaped monofilament yarns having a height h and a width w, where for each oval shaped monofilament yarn, h is less than a radius of a circular yarn of approximately the same size as said oval shaped monofilament yarn.

2. The papermaker's fabric for use in the press section of a papermaking machine of claim 3 wherein each of said oval shaped monofilament yarns has a height in the range of 4 to 20 mil and a width in the range of 6 to 25 mil.

3. The papermaker's fabric of claim 1 wherein said base fabric layer has the cabled monofilament oval yarns in a machine direction.

4. The papermaker's fabric of claim 1 wherein said base fabric layer has the cabled monofilament oval yarns in a cross machine direction.

5. The papermaker's fabric of claim 1 wherein said base fabric layer has cabled monofilament yarns in the machine direction and cross machine direction.

6. The papermaker's fabric of claim 1 wherein all yarns in said base fabric layer are cabled monofilament yarns.

7. The papermaker's fabric of claim 3 wherein all yarns in the machine direction of said base fabric layer are cabled monofilament yarns.

8. The papermaker's fabric of claim 4 wherein all yarns in the cross machine direction of said base fabric layer are cabled monofilament yarns.

9. The papermaker's fabric of claim 1 wherein each of the cabled monofilament yarns has four oval shaped monofilament yarns.

10. The papermaker's fabric of claim 1 wherein said base fabric layer is a single layer fabric.

11. The papermaker's fabric of claim 1 wherein said base fabric layer is a double layer fabric.

12. The papermaker's fabric of claim 1 wherein said base fabric layer is a triple layer fabric.

13. The papermaker's fabric of claim 1 wherein said base fabric layer is a laminated fabric.

14. A method of manufacturing a papermaker's fabric for use in the press section of a papermaking machine comprising the steps of:

providing a plurality of oval shaped monofilament yarns, each of said oval shaped monofilament yarns having a height h and a width w, where for each oval shaped monofilament yarn, h is less than a radius of a circular yarn of approximately the same size as said oval shaped monofilament yarn;

cabling said oval shaped monofilament yarns to form cabled monofilament oval yarns, each of said cabled monofilament oval yarns having at least two oval shaped monofilament yarns; and weaving a base fabric layer from said cabled monofilament oval yarns.

* * * * *